United States Patent [19]

Yapp et al.

[11] Patent Number: 5,016,806

[45] Date of Patent: May 21, 1991

[54] TUBE WELD MILL

[75] Inventors: John R. Yapp, Kingswinford; Peter R. Hill, Birmingham, both of United Kingdom

[73] Assignee: 501 Senior Bigwood Limited, West Midlands, United Kingdom

[21] Appl. No.: 517,238

[22] Filed: May 1, 1990

[51] Int. Cl.[5] ..... B21J 5/14

[52] U.S. Cl. ..... 228/147; 72/181; 72/182; 72/238

[58] Field of Search ..... 72/176, 179, 182, 238, 72/239, 249, 181, 226, 238; 228/147

[56] References Cited

U.S. PATENT DOCUMENTS 3,901,060 8/1975 Corradini ..... 72/179

4,939,919 7/1990 Chezzi ..... 72/249

*Primary Examiner*—Lowell A. Larson

*Assistant Examiner*—Michael J. McKeon

*Attorney, Agent, or Firm*—Webb, Burden, Ziesenheim & Webb

[57] ABSTRACT

A tube weld mill comprising a plurality of successively disposed roll stands to form a strip to a desired generally tubular configuration and a weld means to weld together the adjacent edges of the thus formed strip, each roll stand having a pair of co-operating rolls, a drive transmission to transmit a rotary drive from a driving means to each of said rolls, means removably to secure at least one of said roll stands to a base, means to disconnect said drive from the roll stand to permit of removal of a roll stand from the base and replacement by the same or another roll stand and the drive transmission permitting said disconnection to be performed at a fixed location independent of variation in the separation of the axes of rotation of the rolls of the roll stand.

8 Claims, 4 Drawing Sheets

TUBE WELD MILL

BACKGROUND OF THE INVENTION

This invention relates to a tube weld mill comprising a plurality of successively disposed roll stands to form a strip to a desired generally tubular configuration and a weld means to weld together the adjacent edges of the thus formed strip to produce a seam welded tube. The tube weld mill preferably has a further plurality of roll stands downstream of the rolling mill to size the tube and/or form the tube to a desired final section. The tube weld mill also preferably has a scarfing means to remove any external weld bead and an ironing pass.

It is necessary to change the rolls of at least one of the roll stands to adapt the machine to produce different sizes of tube or other profile and/or to handle different sizes of strip.

An object of the present invention is to provide an apparatus comprising a plurality of successively disposed roll stands in which roll changes are facilitated.

SUMMARY OF THE INVENTION

According to one aspect of the present invention we provide a tube weld mill comprising a plurality of successively disposed roll stands to form a strip to a desired generally tubular configuration and a weld means to weld together the adjacent edges of the thus formed strip, each roll stand having a pair of cooperating rolls, a drive transmission to transmit a rotary drive from a driving means to each of said rolls, means removably to secure at least one of said roll stands to a base, means to disconnect said drive from the roll stand to permit of removal of a roll stand from the base and replacement by the same or another roll stand and the drive transmission permitting said disconnection to be performed at a fixed location independent of variation in the separation of the axes of rotation of the rolls of the roll stand.

The drive transmission may comprise a flexible coupling means to couple at least one roll of the stand to a first clutch member at said fixed location and drivingly connectable to a second clutch member at said fixed location which is drivingly connected to a driving means.

The flexible coupling may comprise a shaft coupled by a universal joint at one end to the first clutch member and coupled by a universal joint at the other end to the movable roll in combination with means to accommodate variation in separation of the roll from the first clutch member.

The roll stand, first clutch member and drive transmission may be mounted on a sub-frame, the sub-frame being removably mounted on said base.

The second clutch member and driving means therefore may be mounted on a support which is movable relative to the fixed location to move said clutch members into and out of inter-engagement.

The support may be movable relative to the fixed location by a drive means which may comprise at least one rack and pinion.

The pinion may be rotated by means of a linear fluid operated motor or other power source. A plurality of pinions may be provided with link means interconnecting the pinions.

BRIEF DESCRIPTION OF THE DRAWINGS

A tube weld mill embodying the invention will now be described by way of example with reference to the accompanying drawings wherein.

DESCRIPTION OF THE PREFERRED EMBODIMENTS

Figure 1:
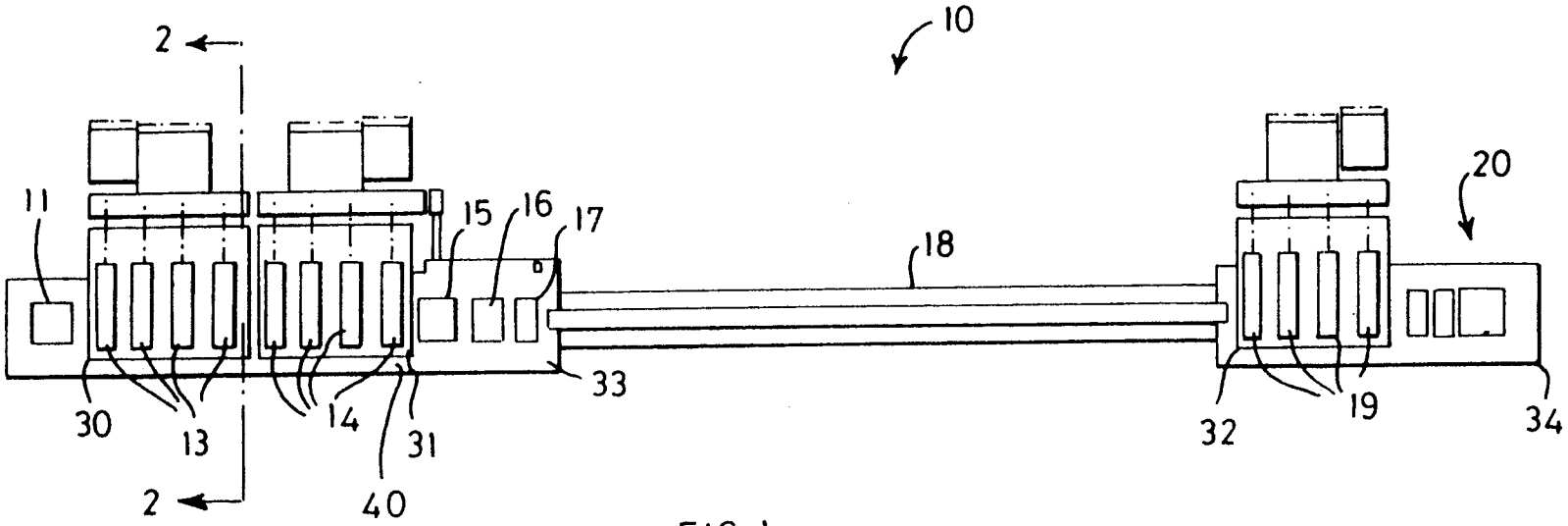
FIG. 1 is a diagrammatic plan view of a tube weld mill embodying the invention.

Referring to the drawings, a tube weld mill 10 comprises an entry guide 11 for strip, in the present example steel strip, of up to 240 mm width and typically having a thickness lying in the range 0.7 mm to 4.4 mm, although these dimensions are given by way of example only and the invention may be applied to a strip of other material and dimensions.

Downstream of the entry guide 11 is provided a first plurality of roll stands 13 which provide a breakdown section and downstream of the roll stands 13 is a second plurality of roll stands 14 which comprise a fin forming section. Downstream of the fin forming section 14 is a conventional weld means 15 followed by a scarfing means 16 to remove by cutting any external weld bead, although if desired other means for removing the weld bead may be provided, such as grinding, particularly where the strip is, for example, a stainless steel. Downstream of the scarfing means 16 is a driven ironing pass 17 of conventional form in which the tube is ironed.

Downstream of the ironing pass 17 is a coolant trough 18 where the formed tube passes through a suitable coolant liquid in conventional manner.

Downstream of the coolant trough 18 is a further plurality of roll stands 19 which provide a sizing section where the tube is formed to a desired final size. If desired, however, instead of a sizing section a different plurality of roll stands may be provided to form the tube leaving the coolant trough 18 to a desired final configuration which, for example, may be elliptical or square.

Downstream of the further plurality of roll stands 19 is provided a turks head assembly 20 for final straightening and shaping of the tube.

The configuration of the rolls in the sections 13, 14 and 19, together with the details of the roll stands, as well as details of the welding means, scarfing means, ironing pass, coolant trough and turks head, are all conventional and so detailed description is therefore not necesary as their details will be fully familiar to a person of skill in the art.

The plurality of roll stands 13, 14 and 19 of each section are each mounted on a sub-frame 30, 31, 32 respectively. Each sub-frame 30, 31, 32 is removably mounted on an upwardly facing part 48 of a base 33, 34 by means of hydraulically operated, or other, clamping means 35.

The features hereinafter to be described are applicable to all the sub-frames and so will be described in relation to the sub-frame 30 only.

The clamping means 35 comprises two sets of hydraulically operated rams 36, the rams of each set being disposed at spaced positions longitudinally of the sub-frame. Each ram 36 has a piston rod 37 which is pivotally connected to a clamping lever 38 so that the lever can be moved from the full line position shown in FIG. 2 to the dotted line position in which it engages a clamping flange 39 provided on a respective longitudinally extending member 40 of the sub-frame 30.

The clamping means 35 also comprises a further set of hydraulically operated rams 41 having a piston rod 42 which carries a cam surface 43 which acts on a tapered surface 44 provided on a further longitudinally extending member 45 of the sub-frame 30. The ram 41 ensures that the sub-frame 30 is moved to the right in FIG. 2 until an inclined surface 46 of the member 45 engages a correspondingly inclined datum surface 47 provided on the base 33 and the inclined co-operating surfaces 43, 44 and 46, 47 provide a downwardly inclined force.

By releasing the clamping means 35 and disengaging a rotary drive to the roll stand, as hereinafter to be described, the sub-frame 30 and the plurality of roll stands 13 fixed thereon, may be removed from the base 33 and either replaced by a different sub-frame with other roll stands thereon, having already been adjusted for use. That is to say, having rolls of appropriate size mounted on the roll stands and the roll separations having been set. Alternatively, of course, the same sub-frame could be replaced after carrying out appropriate work thereon at a position remote from the tube weld mill.

A rotary drive is provided to each roll supporting shaft 50, 51 of each roll stand 13 by means of a drive transmission comprising flexible drives 52, 53 and first clutch members 56, 56*a* respectively. The flexible drives 52, 53 comprise shafts 54, 54*a* connected by a universal joint 55, 55*a* at one end to a first clutch member 56, 56*a* and by a further flexible joint 57, 57*a* at the other end to the roll support shafts 50, 51. The shafts 54 54*a* are telescopic to accommodate variation in distance, between the roll support shafts 50, 51 and a shaft 58, 58*a* upon which the first clutch part 56, 56*a* is mounted, as a result of movement of the roll shafts 50, 51 as necessary to accommodate different sizes of rolls and/or strip thickness. The shafts 58 and 58*a* are carried in bearings carried on a fixed support stand 59 which, like the roll stand uprights 13*a* is fixed relative to the sub-frame 30.

It will be appreciated that the axes of rotation X, Y of the shafts 58 remain fixed whilst adjustment of at least one of the roll support shafts 50, 51 up and down in the uprights 13*a* of the roll stands 13 is permitted.

The above mentioned maintenance of the first clutch members 56, 56*a* at a fixed location and hence the maintenance of the axes of rotation X, Y thereof at a fixed location, permits of simple and easy connection and disconnection of clutches 60, 60*a* provided by the first clutch members 56, 56*a* and second clutch members 61, 61*a* which are fixed to output shafts 62 of a gearbox 63 driven by a belt drive 64 from an electric motor 65.

The motor 65 and gearbox 63 are mounted on a support 70 which is movable rectilinearly in the direction of the arrow A in FIG. 2 relative to a base plate 93, as hereinafter to be described in more detail. Thus, when it is desired to replace the plurality of roll stands 13, the support 70 is first moved to the right in FIG. 2 to disengage the second clutch members 61, 61*a* from their associated first clutch members 56, 56*a*. The hydraulic clamping means 35 is then operated to release the sub-frame 30 from the base 33 following which the sub-frame 30 and associated roll stands and drive transmission means can be lifted from the support 33 by a crane or other convenient means.

Figure 2:
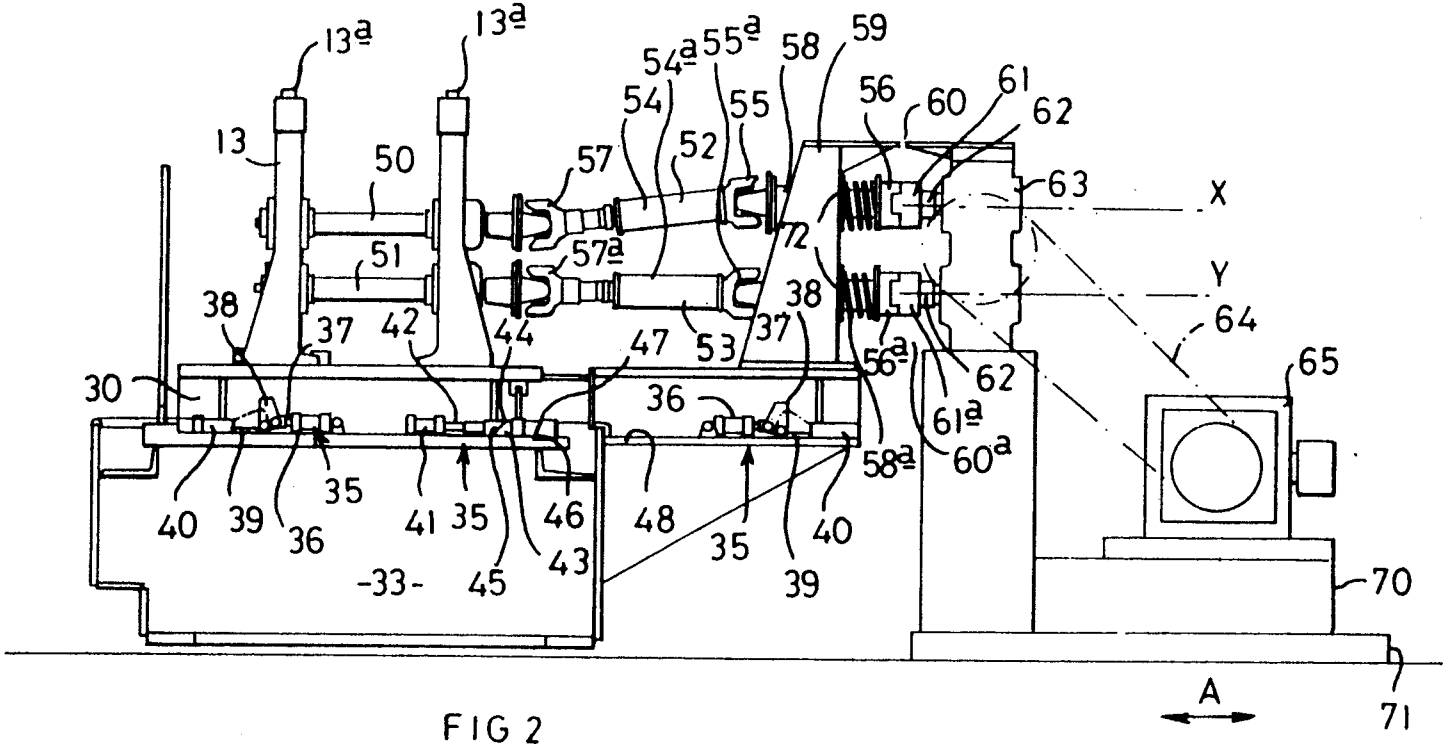
FIG. 2 is a cross-section, to an enlarged scale, on the line 2—2 of FIG. 1.

When a sub-frame and associated roll stands and drive transmission means is to be replaced on the base 33, it is simply necessary to lower the sub-frame 30 and parts carried thereon onto the surface 48, operate the clamping means 35 and then move the support 70 to the left in FIG. 2 to re-engage the clutch parts. The first clutch parts 56, 56*a* are splined to their associated shafts 58, 58*a* and are spring biased towards the second clutch parts 61, 61*a* by coil compression springs 72 so that the first clutch parts 56, 56*a* can be displaced to the left in FIG. 2 on movement of the support 70 to the left in FIG. 2 if the teeth of the first and second clutch parts happen not to be aligned and so that upon initial rotation of the clutch parts 61, 61*a* by the motor 65, rotation relative to the clutch parts 56*a* for a limited extent will take place until the springs 72 bias the first clutch part 56 into driving engagement with the second clutch parts 61, 61*a*.

Thus connection and disconnection of the drive by the clutches 60, 60*a* can be achieved automatically irrespective of the separation of the roll support shafts 50, 51.

Figure 3:
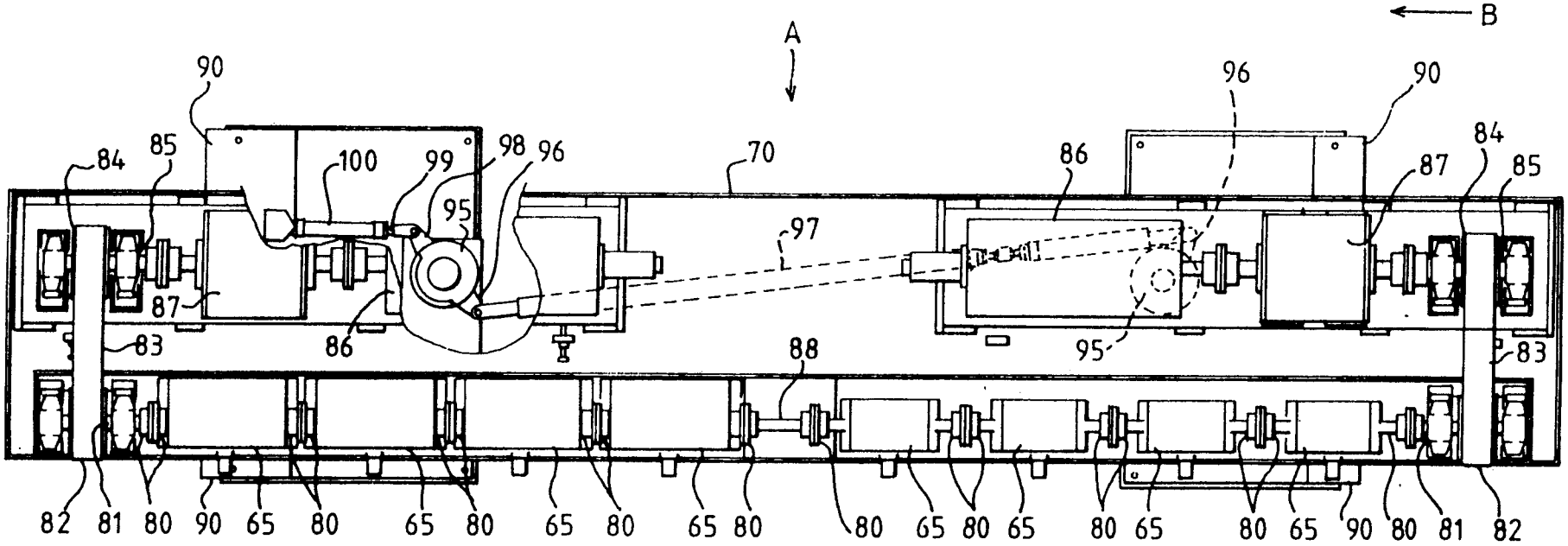
FIG. 3 is a plan view, to an enlarged scale, showing part of the tube weld mill of FIG. 1.
Figure 4:
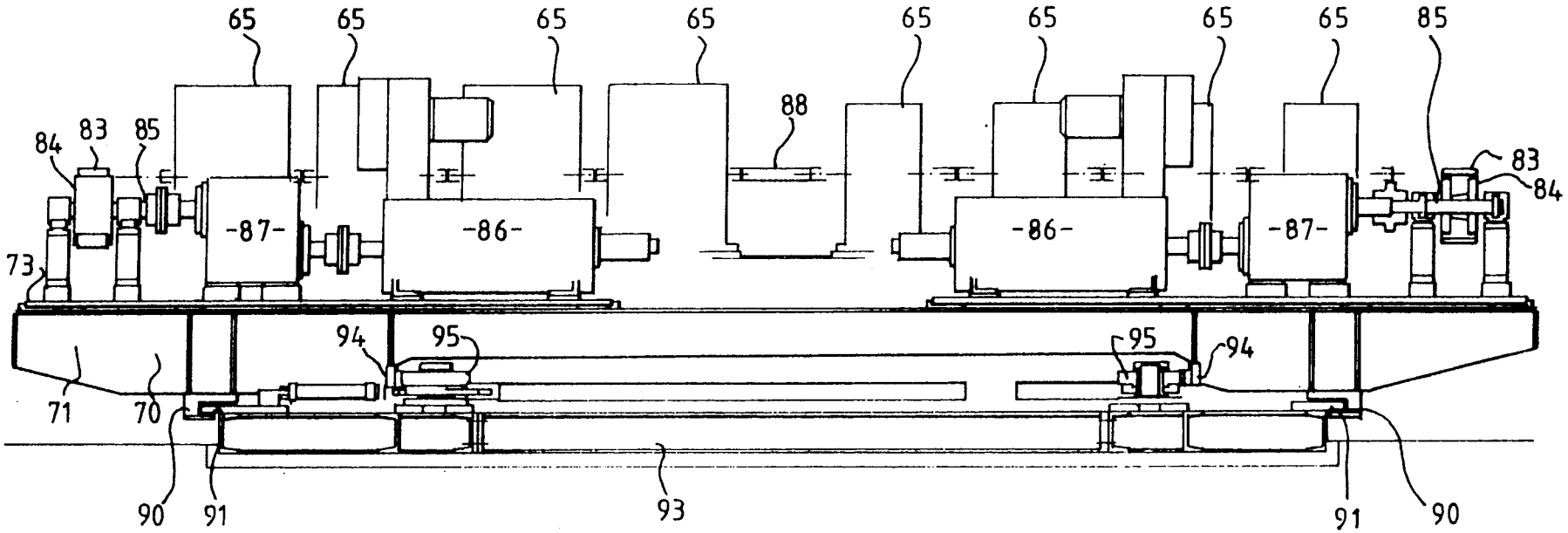
FIG. 4 is a view on the line A of FIG. 3.

Referring now to FIGS. 3 to 4 the support 70 comprises a frame comprising longitudinally extending beams 71 supporting a deck 73 upon which a plurality of gear boxes 65, one for each roll stand 13, are provided. The gear boxes 65 have input shafts 80 which extend through each gearbox and project from opposite ends thereof and the input shafts of adjacent gearboxes are inter-connected by conventional flanged couplings, whilst the end input shafts of the end gearboxes are connected to a shaft 81 driven by a pulley 82 through a belt 83 from a pulley 84 carried on a shaft 85 driven from an electric motor 86 through a reduction gearbox 87. In this example the gearboxes for the roll stands 13 of the breakdown section and the roll stands 14 of the forming section are carried on a single support 70 and are coupled together by a coupling shaft 88, but if desired the gearboxes for the stands of each section may be independently driven, in which case the coupling shaft 88 would be omitted. Further, if desired, the gearboxes and motor for the roll stands of each section may be mounted on a separate support and the supports independently driven into and out of clutching engagement, but in the example illustrated this is not the case.

The beams 70 carry a slideway 90 which engages with a slide 91 provided on a base 93. In the example illustrated the slideway 90 at each side of the base 93 is made in two parts but, if desired, may comprise a single member. Also provided on the base 93 are a pair of racks 94 engaged with pinions 95 rotatably mounted on the underside of the frame 70 and provided with radially extending arms 96 which are inter-connected by a link 97. One of the pinions 95 has a second radially extending arm 98 which is diametrically opposite the arm 96 and is connected to a piston rod 99 of a linear hydraulic motor 100. Thus, extension and retraction of the piston rod 99 causes rotation of the pinion 95 connected thereto and thus rotation of the other pinion 95 via the link 97, thereby driving the pinions along the racks 94 and hence causing the support 70 to slide along the slides 91 on the base 93 to move the second clutch members 61, 61*a* into and out of driving engagement with the first clutch members 56, 56*a*.

We claim:

1. A tube weld mill comprising a plurality of successively disposed roll stands to form a strip to a desired generally tubular configuration and a weld means to weld together the adjacent edges of the thus formed strip, each roll stand having a pair of co-operating rolls, a drive transmission to transmit a rotary drive from a driving means to each of said rolls, means removably to secure at least one of said roll stands to a base, wherein the drive transmission comprises a flexible coupling means to couple at least one roll of the stand to a first clutch member at a fixed location, the first clutch member being drivingly connectable to a second clutch member at said fixed location which is drivingly connected to a driving means.

2. A mill according to claim 1 wherein the flexible coupling comprises a shaft coupled by a universal joint at one end to the first clutch member and coupled by a universal joint at the other end to the movable roll in combination with means to accommodate variation in separation of the roll from the first clutch member.

3. A mill according to claim 1 wherein the roll stand, first clutch member and drive transmission are mounted on a sub-frame, the sub-frame being removably mounted on said base.

4. A mill according to claim 1 wherein the second clutch member and driving means therefore are mounted on a support which is movable relative to the fixed location to move said clutch members into and out of inter-engagement.

5. A mill according to claim 4 wherein the support is movable relative to the fixed location by a drive means.

6. A mill according to claim 5 wherein the drive means comprises at least one rack and pinion.

7. A mill according to claim 6 wherein the or each pinion is rotated by means of a linear fluid operated motor or other power source.

8. A mill according to claim 7 wherein a plurality of pinions are provided with link means inter-connecting the pinions.

* * * * *

UNITED STATES PATENT AND TRADEMARK OFFICE

CERTIFICATE OF CORRECTION

PATENT NO. : 5,016,806

DATED : May 21, 1991

INVENTOR(S) : John R. Yapp and Peter R. Hill

It is certified that error appears in the above-identified patent and that said Letters Patent is hereby corrected as shown below:

On Title Page: after Assignee: delete --501--.

Abstract Line 9 after "permit" delete --of--.

Column 1 Line 31 "cooperating" should read --co-operating--.

Column 1 Line 35 after "permit" delete --of--.

Column 3 Line 51 after "permits" delete --of--.

Signed and Sealed this

Thirteenth Day of October, 1992

*Attest:*

DOUGLAS B. COMER

*Attesting Officer*

*Acting Commissioner of Patents and Trademarks*